US005818166A

United States Patent [19]

Karpov et al.

[11] Patent Number: 5,818,166

[45] Date of Patent: Oct. 6, 1998

[54] FIELD EMISSION DEVICE WITH EDGE EMITTER AND METHOD FOR MAKING

[75] Inventors: Leonid Danilovich Karpov; André Petrovich Genelev, both of Austin, Tex.; Vladimir Anatolevich Dratch, Krasnoyarsk, Russian Federation

[73] Assignee: SI Diamond Technology, Inc., Austin, Tex.

[21] Appl. No.: 678,433

[22] Filed: Jul. 3, 1996

[51] Int. Cl.[6] ..... H01J 1/30

[52] U.S. Cl. ..... 313/495; 313/309; 313/336; 313/351; 313/355

[58] Field of Search ..... 313/495, 497, 313/308, 309, 336, 351, 311, 355

[56] References Cited

U.S. PATENT DOCUMENTS

| | | | |
|---|---|---|---|
| 3,789,471 | 2/1974 | Spindt et al. | 29/25.17 |
| 4,901,028 | 2/1990 | Gray et al. | 330/54 |
| 4,987,377 | 1/1991 | Gray et al. | 330/54 |
| 5,055,077 | 10/1991 | Kane | 445/50 |
| 5,136,764 | 8/1992 | Vasquez | 29/25.01 |
| 5,214,346 | 5/1993 | Komatsu | 313/309 |
| 5,214,347 | 5/1993 | Gray | 313/355 |
| 5,281,890 | 1/1994 | Kane | 313/309 |
| 5,320,570 | 6/1994 | Kane | 313/336 X |
| 5,382,185 | 1/1995 | Gray et al. | 445/49 |
| 5,397,957 | 3/1995 | Zimmerman | 313/336 X |
| 5,445,550 | 8/1995 | Xie et al. | 445/24 |
| 5,449,970 | 9/1995 | Kumar et al. | 313/495 |
| 5,457,355 | 10/1995 | Fleming et al. | 313/336 |
| 5,463,271 | 10/1995 | Geis et al. | 313/346 R |
| 5,463,277 | 10/1995 | Kimura et al. | 313/336 X |
| 5,469,014 | 11/1995 | Itoh et al. | 313/336 X |
| 5,583,393 | 12/1996 | Jones | 313/336 X |

FOREIGN PATENT DOCUMENTS

| | | |
|---|---|---|
| 0501785A2 | 2/1992 | European Pat. Off. . |
| 4010909A1 | 10/1991 | Germany . |
| AC 376826 | 5/1973 | U.S.S.R. . |
| 2254486 | 7/1992 | United Kingdom . |
| WO 92/16606 | 9/1992 | WIPO . |

OTHER PUBLICATIONS

McGruer et al., "Oxidation–Sharpened Gated Field Emitter Array Process," *IEEE Transactions on Electron Devices*, vol. 38, No. 10, Oct. 1991.

Flelming et al., "Fabrication and Testing of Verical Metal Wedge Devices with Well Defined Gate to Emitter Separation," *8th International Vacuum Microelectronics Conference Technical Digest*, pp. 257–260, 1995. No Month.

*Primary Examiner*—Ashok Patel

*Attorney, Agent, or Firm*—Winstead Sechrest & Minick P.C.

[57] ABSTRACT

Thin-film edge emission devices and methods for forming are provided. The emitters are formed to have extended edges. They are formed by oblique deposition on a surface of material which extends from a substrate. The material is substantially removed to leave the thin-film emitter. A gate may then be formed around the emitter. Arrays of such thin-film emitters may be used in a variety of electronic devices.

8 Claims, 5 Drawing Sheets

FIELD EMISSION DEVICE WITH EDGE EMITTER AND METHOD FOR MAKING

FIELD OF THE INVENTION

This invention relates to vacuum microelectronics and field emission devices. In particular, a device for producing electron emission from edges of one or more layers vertically extending from a substrate, either gated or ungated, is provided, along with methods for forming such device.

BACKGROUND OF THE INVENTION

Field emission devices (FEDs) and methods for producing such structures are known. In general, FEDs comprise edge or tip emitters and an electrode near the emitter such as to create a high intensity electric field of about $1\times10^7$ volts per centimeter at the emitter edge or, in the case of needle emitters, at the tip of the needle. This high field causes electron extraction from the solid emitter to vacuum. Dependent on its application, FEDs may contain several electrodes which control the electron beam. Needle emitters and methods for producing such structures are disclosed in U.S. Pat. No. 3,789,471. In such devices, a multi-layer structure of metal-dielectric-metal is applied to the surface of a substrate. Then multiple holes are formed in the top metal layer, which will serve as an accelerator electrode, and holes are etched therethrough in the dielectric layer. After that a liftoff mask is formed on the surface of the structure with holes brought into alignment with the holes in the metal layer. Then needle emitters are formed in the liftoff mask by closing off the holes through evaporation of material from two sources, during which a source of emitter material is projected onto the surface of the film sandwich essentially normal to the surface, while at the same time the other source is directed at the same surface at an angle. During the deposition process, the substrate is rotating normal to its surface. After the holes are essentially closed off, the masking material is removed by wet etching. This method allows production of FEDs with cone-like needle emitters and an accelerator electrode. However, this method of producing the structure is complex since it requires alignment of the structure and suitability of deposition rates between two material sources. The method also allows carrying out a final step of microtip fabrication without substrate rotation and with a deposition of emitter material normal to the substrate surface. However, production of emitters having very small radius of curvature and good emission properties is complex.

An alternative method of producing FEDs having a needle-like structure is described in "Oxidation-Sharpened Gated Field Emitter Array Process," IEEE Transactions on Electron Devices 38, pp. 2389–91, 1991. This method includes stages of forming an insulator layer of silicon dioxide on a silicon substrate by oxidation, masking the silicon dioxide and etching, stripping the mask and forming silicon pedestals by reactive ion etching. Silicon dioxide is then deposited by electron beam evaporation, which must be highly directional to keep the sides of the silicon pedestals exposed. Then the silicon pedestals are thermally oxidized to form sharp tips and metal is evaporated to form a self-aligned gate. Finally, silicon dioxide is etched. It is necessary that the geometry profile of the silicon posts and the thickness of the evaporated silicon dioxide and of the thermally oxidized silicon dioxide be very well defined in order to provide good control over the field emission current.

Other fabrication methods are known in the art for cone-like emitters, but with such emitters depending on very small radius of curvature, field emission current may not be stable in time since the radius of curvature tends to increase with time under the influence of ion bombardment by residual gas. Emitters having larger radius of curvature are less susceptible to such effect.

Known also are vertical thin-film edge emitter structures, gated or ungated. Such device is described in U.S. Pat. No. 5,382,185. This structure may be formed by anisotropic chemical etching to form posts on a substrate, then depositing layers of emitter material over the posts of the textured surface. Thus, cylinders of emitter surfaces are formed. If a gated device is formed, the gate material layer is deposited parallel to the emitter material layer. Such geometry will have a smaller ratio of electric field enhancement than a gate which is parallel to the substrate plane. Also, this structure may increase noise or parasitic field emission current from the gate edge.

Also known in the prior art is a triode electron emission device which includes a gate arranged parallel to the substrate surface with emitters shaped as vertical film emitters. ("Fabrication and Testing of Vertical Metal Wedge Devices with Well Defined Gate to Emitter Separation," 8th International Vacuum Microelectronics Conference Technical Digest, pp. 257–260, 1995) The emission current of such emitters is stable in time; however, the device requires relatively high voltage applied to the gate. Also, the electron beam emitted has a relatively large spread angle and may be partially intercepted by a gate. In addition, the fabrication process of the above device is relatively complex.

Though edge field emitter structures are known and provide emission in a form which is advantageous over needlepoint emitters, simpler methods of fabricating such structures are needed along with a structure having a gate parallel to the plane of the substrate surface and in an advantageous position thereto. Such geometrical configuration of a gate structure can provide greater enhancement of electric field at the surface of the emitter. Also, the structure having a gate parallel to the substrate surface can avoid or minimize noise or parasitic field emission current which can arise from the gate edge. Also needed is simpler method for fabricating such edge emitter devices and a method for minimizing variations in emitter current in different areas of an emitter array.

SUMMARY OF THE INVENTION

An edge field emission device is provided to provide a source of electrons for a variety of possible applications. The emitters are in a linear or curvilinear form extending from a substrate, so as to provide an extended edge. The emitters may be made up of a single conductor or may be made from a plurality of thin layers. Preferably, the emitter edge has low work function. A preferred emitter has a carbon thin-film between two metal films, because carbon is known to have a high melting temperature and is robust to an ion beam. A silicon carbide layer over the emitter may also be used to minimize variations in current over an array of emitters. A gate electrode is also provided which is parallel to the substrate and symmetric around the edge emitter.

Method for forming such edge emission devices is also provided. On a conducting substrate, a masking layer and photoresist layer are deposited and a pattern of windows is formed in the photoresist, through which the masking layer is etched. A layer of a material such as copper is then deposited and the masking layer is dissolved away, leaving posts of the copper. Then one of more thin emitter layers are deposited by oblique deposition over the side and top of the posts. The emitter layer or layers is then etched off the top of the posts and the posts are substantially dissolved away, leaving the emitter layer or layers rising from the substrate. A gate for the emitters may then be formed by depositing dielectric and conductive layers on the substrate and over the emitters, forming a surface having bulges over the emitters. The surface having bulges is then planarized by photoresist, which is then developed to a depth to exposed the tops of the bulges, then the conductive and dielectric layers over and around the emitters are etched to expose the emitter edges, which are surrounded by the gates.

DETAILED DESCRIPTION OF PREFERRED EMBODIMENT

Figure 1:
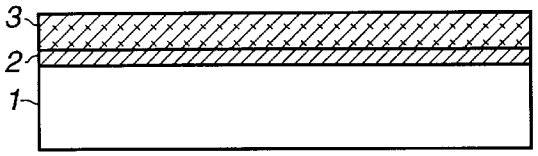
FIG. 1 is a cross-sectional view of the substrate, a conductive layer and a mask layer employed in the method of making the device of this invention.

Referring to FIG. 1, substrate material 1, which may be a dielectric, a semiconductor or a conductor is shown. If the substrate is a dielectric, the surface is coated by conductive layer 2, as shown in FIG. 1; but, if the substrate is not dielectric, coating 2 is not necessary. Conductive layer 2 is applied to substrate 1, preferably to a thickness in the range from about 0.1 micrometers to about 0.5 micrometers. The conductive layer may be chromium, for example, but a variety of conductors may be used. Masking layer 3 may be in the range from about 2 to about 4 micrometers thick, but the thickness is not critical. Layer 3 may be applied by any available process—for example, vacuum evaporation. The masking material may be aluminum.

Figure 2:
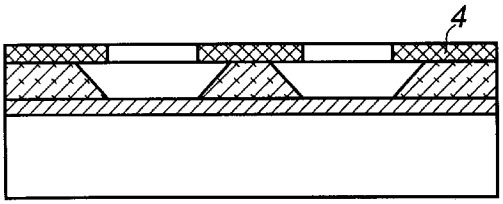
FIG. 2 is a cross-sectional view of the structure of FIG. 1 after etching through windows in the mask.

Now referring to FIG. 2, photoresist mask 4 is shown and holes have been formed in masking layer 3. The holes may be of a variety of shapes and sizes, but in the exemplary description shown in FIGS. 1–18 will be considered to be rectangular. Typical dimensions of such holes may be about 4×10 micrometers. The holes may also be round or any linear or curvilinear shape. The shape, dimensions and spacing between holes may be selected according to the application of the device. The masking layer 3 is etched through windows in the photoresist mask 4 by wet or dry etching.

Figure 3:
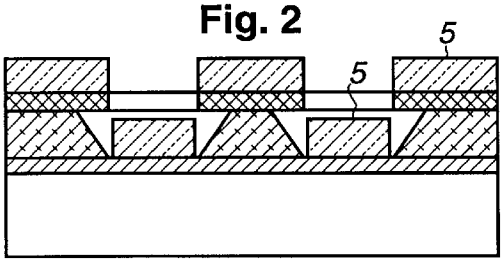
FIG. 3 is a cross-sectional view of the structure of FIG. 2 after a metal layer is deposited on the surface of the structure.

Referring to FIG. 3, metal layer 5, preferably copper, having a thickness in the range from about 1 micrometer to about 10 micrometers is deposited on the surfaces of the structure. The copper thickness and deposition method may vary, depending on the application of the fabricated structure. A suitable deposition method is vacuum evaporation. Deposition may also be performed by electroplating or electrolysis methods.

Figure 4:
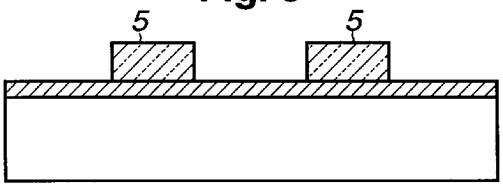
FIG. 4 shows a cross-sectional view of the structure of FIG. 3 after lifting off the mask layer.

Referring to FIG. 4, masking material 3 and photoresist layer 4 have been removed by etching or dissolving the aluminum layers in potassium hydroxide solution, leaving copper posts 5. Then, the layers or multilayers are grown which will ultimately be the emitter material. A variety of materials may be used. The layers may be deposited by oblique vacuum evaporation, preferably at an angle in the range from about 30 to about 45 degrees to the surface of substrate 1. The spacing between posts and the height of the posts is selected to insure that oblique deposition at the selected angle will occur on the substrate and continuously on to the posts from the substrate. The height of the posts is selected according to the height of the edge emitters to be formed.

The material to form the layers may be selected from a wide variety of emitter materials. For example, the layers may be chromium, titanium, chromium/titanium/chromium (three layers), chromium/carbon/chromium, or other single-metals or composite films having a multiplicity of layers, which may include more than three layers. Alternatively, a material having low work function such as barium or lithium may be used. The material in the center layer will be a conductor, but the layers on each side of the center layer may be conductors or dielectrics. The materials on each side of the center material may or may not be the same material. A preferred layer is formed from chromium/carbon/chromium, the carbon being selected to produce a layer having a high melting temperature and being robust to an ion beam. The carbon is preferably deposited by the arc method, so as to minimize deposition of carbon on the shadow side of the posts, but carbon may be deposited by magnetron sputtering, for example, or other methods. A lower work function material in the thin film will allow electron emission at a desired lower threshold electric field.

Figure 6:
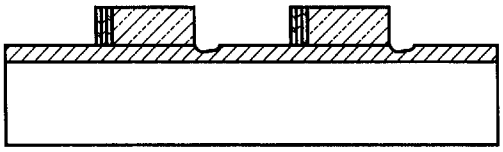
FIG. 6 shows the structure of FIG. 5 after exposure to ion bombardment until conductive layers in emitter material are etched off the top surface of the post.

Referring to FIG. 6, the structure resulting after exposure of the surface to ion bombardment from a beam directed perpendicular to the surface of substrate 1 is shown. Ion bombardment is conducted until layers 6 and 8 and the layer of emitter materials 7 are etched off from the top surface of copper posts 5.

Figure 7:
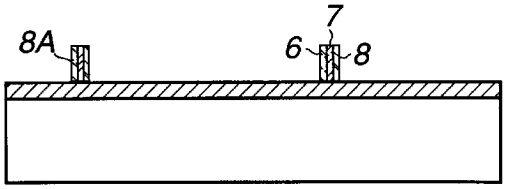
FIG. 7 shows the structure of FIG. 6 after the posts are removed.

Referring to FIG. 7, the copper posts have been removed, for example, by wet etching or dissolution, thereby forming vertical layers 6, 7 and 8 which are preferably approximately perpendicular to the surface of substrate 1.

Figure 5:
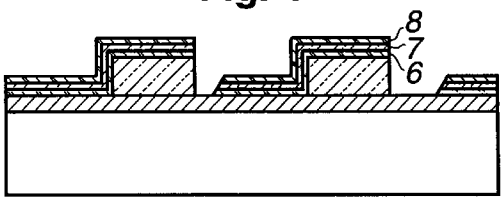
FIG. 5 shows the structure of FIG. 4 after deposition of three layers of material to form a multi-layered film comprising a vertical emitter.

Alternatively, vertical film materials 6, 7 and 8 of FIG. 7 may be formed by a planarization process. In this case, after deposition of vertical film emitters as shown in FIG. 5, the surface of the structure may be planarized by a polyamid film or other such known films. Then polishing can be used to remove the polyamid layers and the layers 6, 7 and 8 of material from the top of copper posts 5. Copper posts 5 and the remaining polyamid layer may then be removed by dissolving.

Alternatively, after the vertical film emitters are formed, layer of silicon carbide 8A may be deposited on the emitters, for example, by sputtering methods, as illustrated in the left side of FIG. 7. For clarity, the layer is not shown on other vertical film emitters in the figures, but is preferably deposited over the surface of all emitters in an array of emitters. The thickness of the silicon carbide layer may be in the range from about 0.03 micrometers to about 0.1 micrometers. The silicon carbide is used to decrease the variation in current from different areas of the emitter array.

Figure 8:
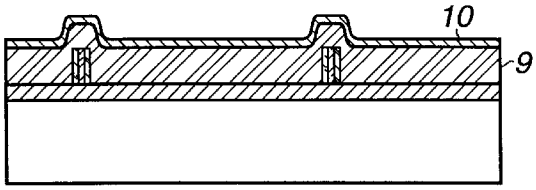
FIG. 8 shows the structure of FIG. 7 after coating with an insulator layer and a conductor layer.
Figure 9:
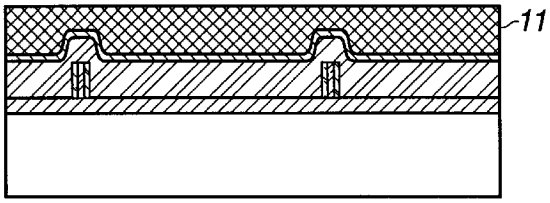
FIG. 9 shows the structure of FIG. 8 after the surface is planarized by a photoresist layer.
Figure 10:
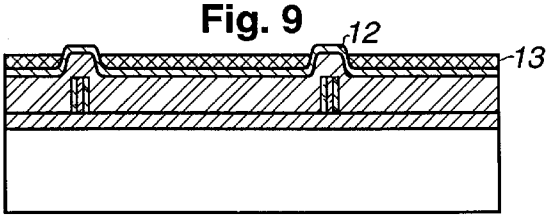
FIG. 10 shows the structure of FIG. 9 after the photoresist exposure and development to expose the tops of the structures.
Figure 11:
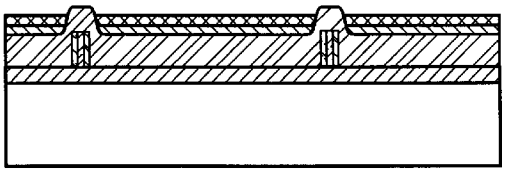
FIG. 11 shows the structure of FIG. 10 after etching to remove the conductive layer from the tops of the protruding structure.
Figure 12:
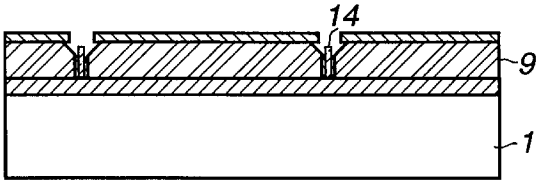
FIG. 12 shows the structure of FIG. 11 after etching off an insulator layer and conductive layers around the film emitter layer.

Referring to FIG. 8, the structure of FIG. 7 after it has been coated with insulator layer 9 and conductive layer 10 is shown. Insulator layer 9 may be silica, for example, which is deposited by known method. The thickness of insulator layer is selected to be approximately that of the height of the vertical film emitters so as to form a surface having bulges over the film emitters. Conductive layer 10 may be molybdenum, for example, at a thickness of about 0.2 micrometers to about 0.4 micrometers, which is deposited by a known method. Referring to FIG. 9, the structure of FIG. 8 after it has been planarized by photoresist layer 11 is shown. A suitable photoresist material is Shypley 1813, which is widely available. This photoresist layer is exposed for a time sufficient to allow development to expose the tops 12 of the bulges formed over the film emitters. For example, a time of about 5 seconds may be used. Such structure is coated with layer 10 of molybdenum. Photoresist layer 13 is then thermally treated and molybdenum layer 10 is etched off to form the structure of FIG. 11. Insulator layer 9 is then etched away from film emitter 7 and the layers on each side of film emitter layers, layers 6 and 8, are etched from around film emitter 7. Layers 6 and 8 serve as reinforcement at the stage of gate structure fabrication and may also increase conductivity along film emitter 7 if they are made of conductors, which is preferable. Finally, in FIG. 12, the gate structure of this invention is shown in cross-section.

Figure 13:
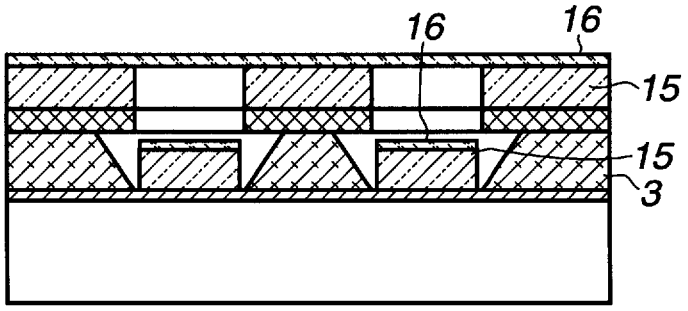
FIG. 13 shows the structure of FIG. 2 after liftoff of the photoresist mask and deposition of two metal layers.
Figure 14:
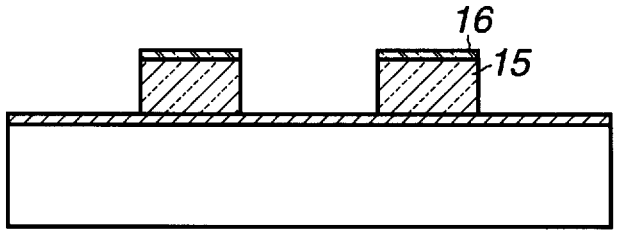
FIG. 14 shows the structure of FIG. 13 after liftoff of the mask and dissolving off as provided in FIG. 4.
Figure 15:
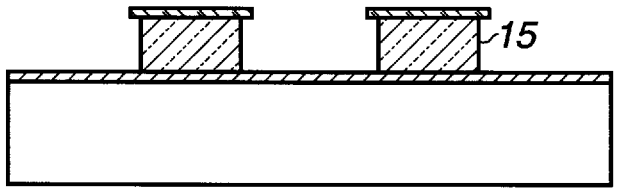
FIG. 15 shows the structure of FIG. 14 after the posts are subjected to etching under the edge of the top metal layer.
Figure 16:
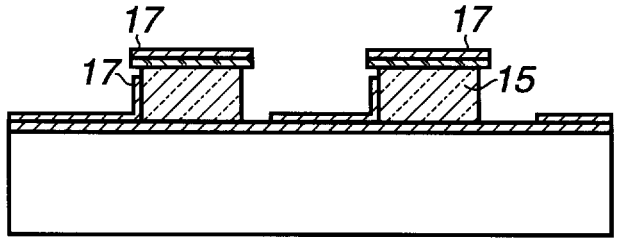
FIG. 16 shows the structure of FIG. 15 after multilayers of emitter material are deposited.
Figure 17:
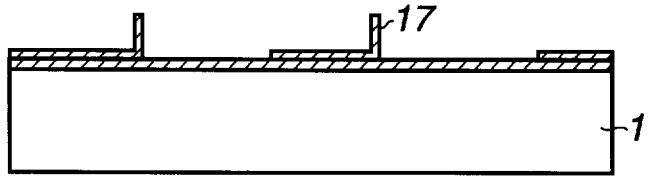
FIG. 17 shows the structure of FIG. 16 after the posts are removed.

In an alternative method for making vertical film emitters, after the structure shown in FIG. 3 is formed, a second metal layer, preferably chromium at a thickness or about 0.1 micrometer, is formed on the first metal, preferably copper, as shown in FIG. 13. After the liftoff step through dissolving layer 3, copper posts 15 topped by chromium layer 16 are formed, as shown in FIG. 14. Then copper posts 15 are subjected to etching under the edge of chromium layer 16 to the extent of about 0.2 to 0.3 micrometer. Then the layers of emitter material are obliquely deposited as described above, preferably at an angle in the range from about 30 to 45 degrees with respect to substrate 1. Copper posts 15 are removed by dissolving to form film emitters 17 as shown in FIG. 17. The gate structure may then be formed as described above and illustrated in FIGS. 8 through 12.

The metal posts (preferably copper) described herein may be formed also by electrolytic deposition. Using this method, a photoresist mask is first applied to the surface of conductive layer 2. The mask is formed with windows in which posts may be grown. The posts may also be coated with a nickel layer, for example, by electrolysis, and the photoresist layer is then removed.

The thickness of the emitter layer of the vertical film emitters of this invention may be in the range from about 0.04 to about 0.1 micrometer. For multilayer films, the thickness of each layer surrounding the emitter layer may have a thickness in the range from about 0.05 to about 0.1 micrometer. The material or materials in the vertical film emitter are selected for good emission properties (resulting from low work function), high melting point, resistance to ion bombardment, low migration ability of surface atoms and low capacity for absorption of molecules or ions of residual gas.

The method of this invention for forming windows in the control electrode makes possible a small width between the control electrode and the emitter, which will male possible low control voltages, such as in the range of 30 to 50 volts. Also, the geometry of the control electrode will cause less defocussing as compared with gate structures in which an emitter is formed in the shape of a vertical cylinder and a window edge in the gate is also cylindrical and encloses the emitter cylinder.

The height of the vertical emitters will be selected according to the application of the device. In the case of microwave gate FEDs, for example, tall vertical emitters, about 6 micrometer high for example, may be fabricated, surrounded by an insulator layer about the same thickness, and a gate formed around the emitter. The larger thickness of the dielectric layer will decrease the electrical capacitance between the gate and the substrate conductive layer.

The self-alignment method of this invention for gate fabrication allows a structure which will avoid short-circuiting between the emitter edges and the gate. It also allows variations in the gate structure and variable distances between the gate and the emitters.

The emitter geometry of this invention, having the shape of a flat sharp edge, is more robust to ion bombardment than the prior art needle or cone-shape emitters. A decrease of height of a film emitter under the influence of ion bombardment will have negligible effect on the coefficient of electric field enhancement, or the increase of electric field at the tip divided by the electric field at a flat surface in the same location.

Figure 18:
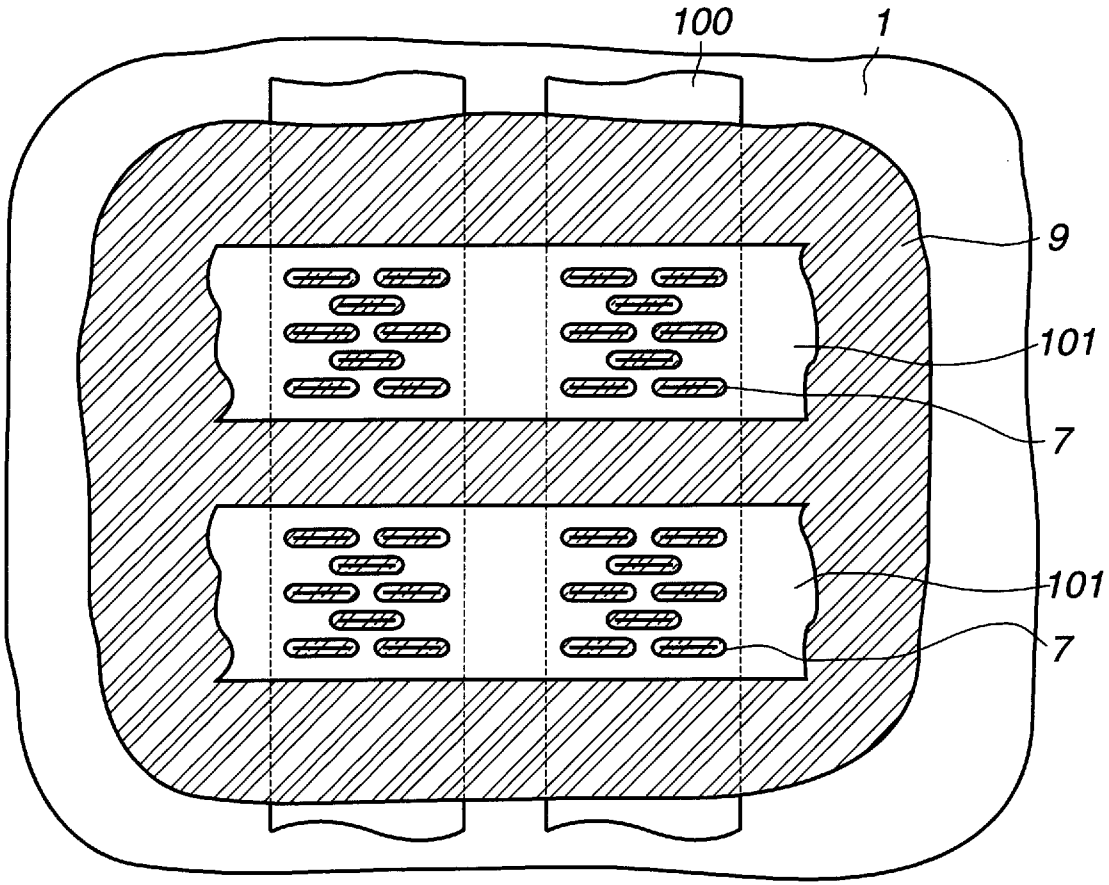
FIG. 18 shows a top view of the field emitters of this invention disposed as an array which may be used in a flat panel display.

FIG. 18 shows an example plan view of the emitters of this invention in an array. Such an array may be used in a flat panel displays, other displays or any other device including a source of electrons from cold emission. The pattern of an array can be varied according to the application, such as parallel lines, crossing lines, segments of lines or curvilinear patterns. Referring to FIG. 18, cathode feedlines 100 are patterned on substrate 1 and are electrically insulated from gate lines 101 by insulator 9. Intersections of cathode lines 100 and gate lines 101 are provided with vertical film emitters 7. A screen coated with phosphor (not shown) may be positioned above the cathode and gate lines to form a flat panel triode field emission display. If the gate lines and gates are not used and an anode is placed parallel to the plane of the cathode, the vertical field emitters may be used in a diode field emission device.

EXAMPLE

A substrate was coated with a thin film of chromium and then a layer of aluminum to a thickness of about 2.4 micrometers. A photoresist mask about 0.7 micrometers thick was then applied, the mask having round holes of diameter about 2 micrometers and about 6 micrometers apart. A liquid etch through the holes was carried out and layers of copper of about 6 micrometers thickness and then chromium were then deposited by electron-beam vacuum deposition. The lift-off mask was then removed by dissolving the photoresist layer and aluminum layer in 3 to 5 per cent KOH solution. Then the remaining copper posts were undercut to about 0.3 micrometers under the edge of the chromium disc, using nitric and acetic acid. Then an emitter layer of tungsten was deposited on the posts by oblique deposition. Then the copper posts were substantially removed by dissolution, thus forming an array of vertical thin-film tungsten emitters.

Figure 19:
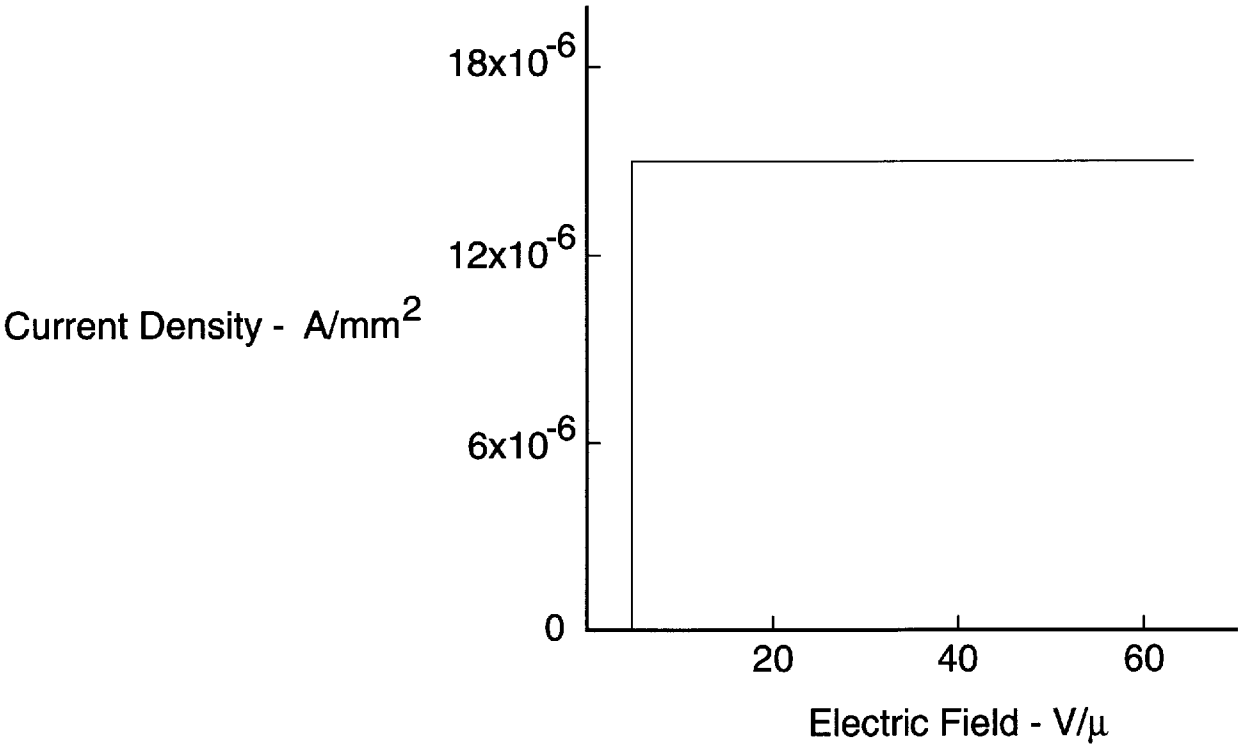
FIG. 19 shows a current vs. voltage curve for titanium emitters according to this invention.

Emission properties of the array were measured at a pressure of $1\times10^{-7}$ torr. The test apparatus for measurement of current-voltage (I-V) characteristics allowed placing a test structure under a test head which had nine anode pins, each of 254 micrometer diameter and located with 2 mm pitch from another anode pin. The tests allowed a comparison of the I-V characteristics in different areas of a test structure. The I-V curves for one of the areas of the test structure with titanium emitters is shown in FIG. 19. Current density is measured in amperes/$mm^2$ and electric field in volts per micrometer. The emitters were about 6 micrometers in height and had a density of $2.88\times10^6$ emitters/$cm^2$.

Figure 20:
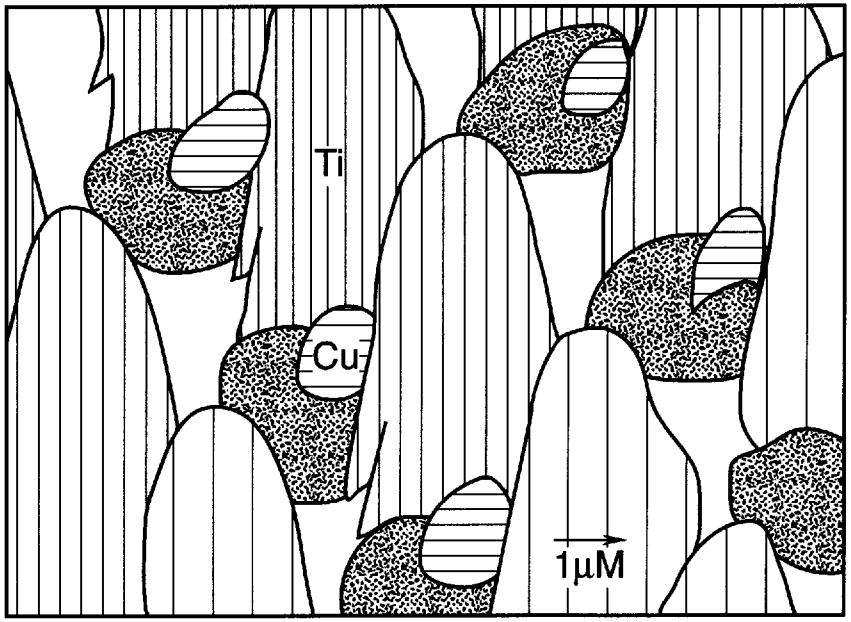
FIG. 20 shows a drawing made from a scanning electron micrograph of an array of emitters according to this invention.

A drawing made from a scanning electron micrograph of the tungsten edge emitters is shown in FIG. 20. The emitters are curved in a plane parallel to the substrate, resulting from the round posts of copper on which the emitters were deposited. They extend approximately 6 micrometers from the substrate and are at a density of $2.88\times10^6$ emitters/$cm^2$. Small remnants of the copper posts can be seen near the substrate, surrounded by larger circular areas from which the copper posts have been dissolved. At the top surface of the emitters is an extended edge from which electrons are extracted in an electric field. The extended edge of the emitter will not be affected by ion bombardment such as will the small radius tip of a needle-tip emitter. The lower the work function of the material of the edge, the lower the threshhold electric field for electron emission of the device.

The invention has been described with respect to its preferred embodiments. Those of ordinary skill in the art may, upon reading this disclosure, appreciate changes or modifications which do not depart from the scope and spirit of the invention as described above or claimed hereafter.

What is claimed is:

1. An edge field emission device, comprising:

a substrate; and a thin-film protuberance extending from said substrate, the protuberance having at least one layer comprising a conductive thin-film and having a top surface comprising an extended edge, wherein the protuberance comprises a plurality of layers, at least one of said layers being conductive, wherein the plurality of layers is comprised of a low work function material disposed between two metal layers.

2. The device of claim 1 wherein the protuberance comprises a plurality of layers, at least one of said layers being conductive.

3. The device of claim 2 wherein the conductive layer is comprised of metal.

4. The device of claim 2 wherein the plurality of layers is comprised of a low work function material disposed between two metal layers.

5. The device of claim 1 wherein the metal layers are positioned below the edge of the low work function material.

6. The device of claim 1 further comprising a coating over the protuberance, the coating being silicon carbide.

7. The device of claim 1 further comprising a gate electrode, the gate electrode being symmetrically disposed around the protuberance.

8. An edge field emission device, comprising:

a substrate; and a thin-film protuberance extending from said substrate, the protuberance having at least one layer comprising a conductive thin-film and having a top surface comprising an extended edge, wherein the protuberance comprises a plurality of layers, at least one of said layers being conductive, wherein the plurality of layers is comprised of a carbon layer disposed between two metal layers.

* * * * *